US009287025B2

(12) United States Patent
Pizzato et al.

(10) Patent No.: US 9,287,025 B2
(45) Date of Patent: Mar. 15, 2016

(54) PROTECTION ASSEMBLY WITH AN OPERATING KNOB FOR AN ELECTRICAL POTENTIOMETER

(71) Applicants: Marco Pizzato, Marostica (IT); Simone Zonta, Bassano del Grappa (IT)

(72) Inventors: Marco Pizzato, Marostica (IT); Simone Zonta, Bassano del Grappa (IT)

(73) Assignee: PIZZATO ELETTRICA S.R.L., Marostica (VI) (IT)

( * ) Notice: Subject to any disclaimer, the term of this patent is extended or adjusted under 35 U.S.C. 154(b) by 102 days.

(21) Appl. No.: 14/376,614

(22) PCT Filed: Oct. 17, 2013

(86) PCT No.: PCT/IB2013/059420

§ 371 (c)(1),
(2) Date: Aug. 4, 2014

(87) PCT Pub. No.: WO2014/060984

PCT Pub. Date: Apr. 24, 2014

(65) Prior Publication Data

US 2014/0375418 A1 Dec. 25, 2014

(30) Foreign Application Priority Data

Oct. 17, 2012 (IT) ..... VI2012A0274

(51) Int. Cl.

| | |
|---|---|
| ***H01C 10/00*** | (2006.01) |
| ***H01C 1/02*** | (2006.01) |
| ***G05G 1/08*** | (2006.01) |
| ***H01C 1/024*** | (2006.01) |
| ***H01C 10/14*** | (2006.01) |
| ***H01C 10/22*** | (2006.01) |

(52) U.S. Cl.
CPC .. *H01C 1/02* (2013.01); *G05G 1/08* (2013.01); *H01C 1/024* (2013.01); *H01C 10/14* (2013.01); *H01C 10/22* (2013.01)

(58) Field of Classification Search
CPC ..... H01C 1/02; H01C 1/08; H01C 1/024; H01C 10/14; H01C 10/22; H01C 10/24
USPC ..... 338/199
See application file for complete search history.

(56) References Cited

U.S. PATENT DOCUMENTS

| | | | | |
|---|---|---|---|---|
| 3,949,347 | A * | 4/1976 | Gilbreath | H01C 10/363 200/500 |
| 3,970,986 | A * | 7/1976 | Seyler | H01C 10/36 200/11 G |
| 4,250,481 | A * | 2/1981 | Kaufman | H01C 10/32 338/163 |

(Continued)

FOREIGN PATENT DOCUMENTS

DE 102008048470 9/2009

*Primary Examiner* — Kyung Lee
(74) *Attorney, Agent, or Firm* — Themis Law

(57) ABSTRACT

A protection assembly with an operating knob (1) for an electrical potentiometer comprises a substantially tubular housing (2) defining a longitudinal axis (L), an electrical adjustment device (3) held within the housing (2) and having an adjustment shaft (4) rotating about the longitudinal axis (L) and an internal variable resistor interacting with a longitudinal end (5) of the shaft (4), an operating knob (6) attached to the other end (7) of the shaft (4), limit stop means (8) for restricting the rotation of the shaft (4) within a predetermined maximum angle of rotation (a). The knob (6) comprises an annular anchoring member (9), which is designed to be removably coupled to the housing (2) and an operating member (10) coupled to the shaft (4) and rotating relative to the anchoring member (9). The anchoring member (9) and the operating member (10) have mutually facing cylindrical surfaces (11, 12), with said limit stop means (8) interposed therebetween to limit the infiltration of external impurities.

9 Claims, 5 Drawing Sheets

(56) References Cited

U.S. PATENT DOCUMENTS 4,439,654 A * 3/1984 Bresin ..... H01H 19/06
200/302.1

5,250,926 A * 10/1993 McSwiggen ..... H01C 1/024
338/164

6,028,502 A * 2/2000 McSwiggen ..... H01C 10/32
200/11 G

* cited by examiner

PROTECTION ASSEMBLY WITH AN OPERATING KNOB FOR AN ELECTRICAL POTENTIOMETER

FIELD OF THE INVENTION

The present invention generally finds application in the field of electric control devices and particularly relates to a protection assembly with an operating knob for an electrical potentiometer.

BACKGROUND ART

Electric variable-resistance devices, commonly known as potentiometers, are known in the art, and are adapted to be connected to an electric circuit to control its electrical quantities by means of a variable resistor.

As a rule, these devices are used, without limitation, as voltage dividers or current regulators, for regulating the electric current that circulates in a circuit.

A particular class of potentiometers includes an electric adjustment device of the rotary type, comprising a shaft that interacts with the variable resistor and rotates about its axis.

The electric adjustment device is in turn held within a tubular housing, whereas the shaft is attached to a knob that is designed to be rotated by a user.

Since these devices are often designed to be installed in particularly harsh environments, such as engine rooms or outdoors, they must be protected from infiltrations of dirt particles, liquids and possibly oxidizing or corrosive substances that might affect their efficiency.

Furthermore, these devices are often exposed to shocks and excessive vibrations that might cause damages to or failures of the moving parts, whereby appropriate protection means should be provided as they are being handled.

DE102008048470 discloses a rotary potentiometer having a housing for receiving the resistor and a knob for engaging the portion of the shaft that projects out of the housing to allow a user to rotate it. This prior art potentiometer also has limit stop means associated with the knob and the housing to restrict the angular range of motion of the shaft and prevent the moving parts of the resistor from violently impacting abutment surfaces.

Furthermore, the device comprises a sealing ring with a central opening for the passage of the shaft, which is adapted to seal the electric adjustment device and prevent infiltration of solid or liquid materials from the installation environment into the housing.

The main drawback of this prior art solution is that a considerable portion of the shaft is external to the sealing element and is not adequately protected against penetration of dirt particles or infiltration of liquids.

Therefore, while this potentiometer ensures adequate protection to its electric parts, it still does not ensure a proper sealing effect against impurities, liquids or corrosive substances that might penetrate the knob.

DE1020080484470, GB940308, EP1691380, DE1980281 and DE8805076 disclose protection devices for electric potentiometers that have all the features as set out in the preamble of claim 1.

Nevertheless, these protection devices are relatively complex and expensive to build, and only partially limit the infiltration of dust or impurities external to the electric potentiometer.

DISCLOSURE OF THE INVENTION

The object of the present invention is to obviate the above drawbacks, by providing a protection assembly with an operating knob for an electrical potentiometer that is highly efficient and relatively cost-effective.

A particular object of the present invention is to provide a protection assembly with an operating knob for an electrical potentiometer that provides protection from dirt particles, liquids and hazardous substances in general to all sensitive mechanical and electrical parts therein.

Another object of the present invention is to provide a protection assembly with an operating knob for an electrical potentiometer that has a small number of parts, and is easy to assemble.

Yet another object of the present invention is to provide a protection assembly with an operating knob for an electrical potentiometer that meets a minimum electrical protection rating IP67 according to EN60529 and is thus totally protected both against penetration of solid bodies and dust and against penetration of liquid drops, water jet splashes and temporary immersion.

These and other objects, as better explained hereafter, are fulfilled by a protection assembly with an operating knob for an electrical potentiometer, as defined in claim 1.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a protection assembly with an operating handle for an electrical potentiometer according to the invention, which is described as a non-limiting example with the help of the annexed drawings, in which.

DETAILED DESCRIPTION OF A PREFERRED EMBODIMENT

Referring now to the accompanying figures, a protection assembly with an operating knob for an electrical potentiometer, generally designated by numeral 1, may be used, as is known in the art, with electrical potentiometers that are adapted to control the electrical parameters of any external electric circuit through the variation of an electrical resistor.

Particularly, the assembly 1 of the invention may be used with potentiometers that are adapted to selectively vary voltage in the circuit and accordingly change the value of electric current in the same circuit.

The assembly 1 of the invention may be used with potentiometers that are suitable both for civil and industrial electrical systems, such as voltage dividers, and/or to control the current supplied to a load, or possibly to generate variable signals for controlling industrial equipment.

Furthermore, the assembly 1 of the invention may be used with potentiometers that are scaled to size for installation in small electronic devices requiring adjustment of one or more control signals.

Figure 1:
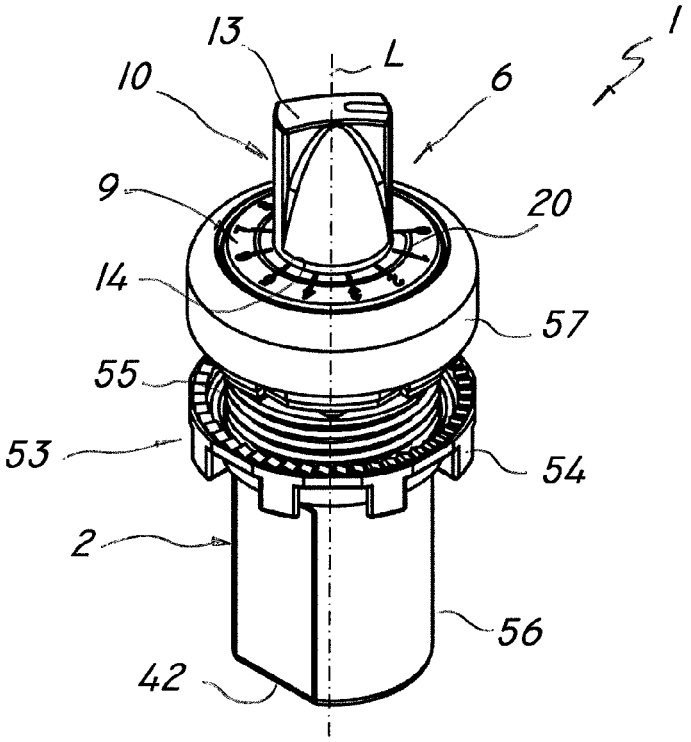
FIG. 1 is a perspective view of a protection assembly with an operating knob for an electrical potentiometer of the invention.
Figure 2:
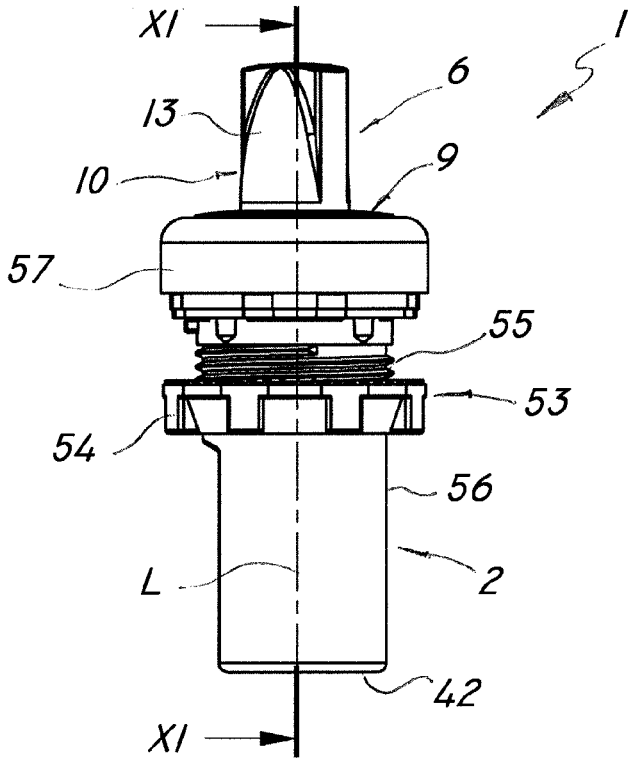
FIG. 2 is a lateral view of the assembly of FIG. 1.
Figure 3:
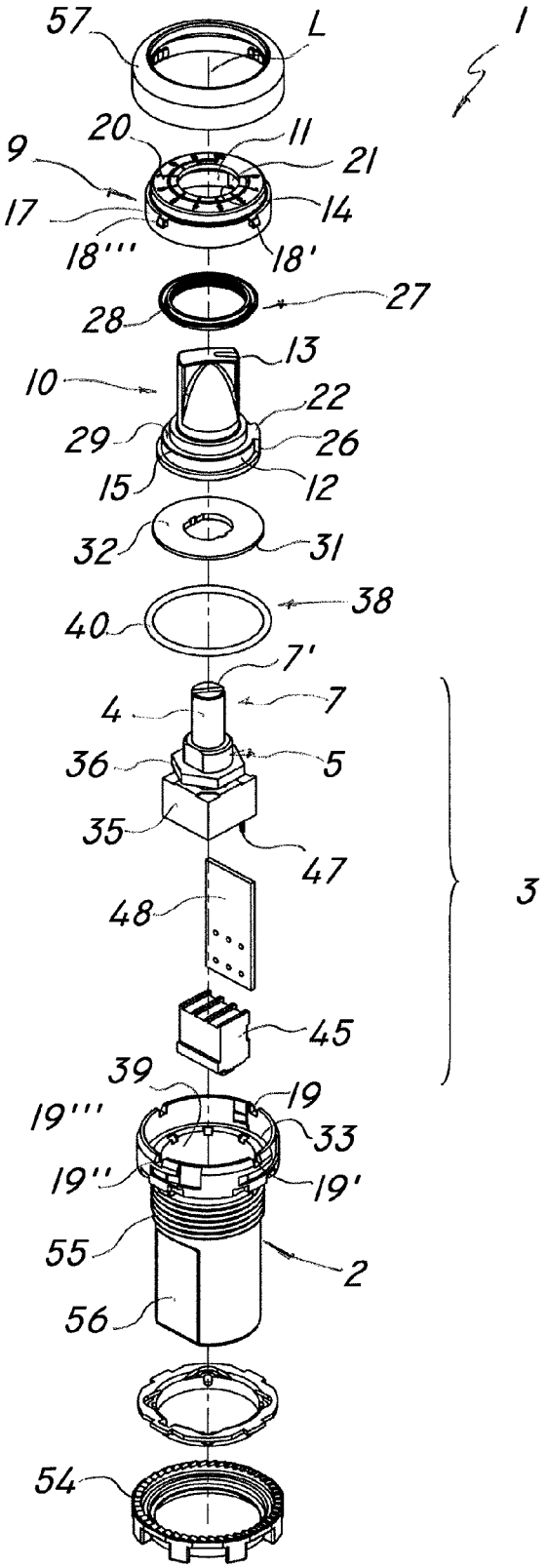
FIG. 3 is an exploded perspective view of the assembly.

As shown in FIGS. 1 to 3, the assembly comprises a substantially tubular housing that defines a longitudinal axis L and is adapted to accommodate therein an electrical adjustment device 3.

The adjustment device 3 in turn comprises an electric circuit with an internal resistor, both not shown and known per se.

The resistor may be connected to an external circuit to be controlled and may be selected as having an instantaneous ohmic value that can be adjusted within a given range.

Particularly, the adjustment device 3 comprises a substantially longitudinal adjustment shaft 4 which is rotatably accommodated in the housing 2 to rotate about the longitudinal axis L of the housing 2 in the assembled state.

The shaft 4 has one end 5 designed to be associated with the internal circuit and the other end 7 attached to a knob 6 for causing rotation of the shaft 4 about the axis L.

Limit stop means 8 are also provided, which are adapted to restrict the rotation of the shaft 4, in both directions of rotation, to a predetermined maximum angle of rotation α.

Conveniently, the maximum angle of rotation α as defined by the limit stop means 8 may be the same as the maximum angle of rotation of the internal variable resistor.

According to a peculiar feature of the invention, the knob 6 comprises an annular member 9 that is adapted to be removably secured to the housing 2 to rotatably retain a substantially cylindrical operating member 10, rotatably integral with the shaft 4.

Advantageously, the limit stop means 8 may be contained in the knob 6 and may be particularly interposed between two mutually coaxial and facing cylindrical surfaces 11, 12, of the anchoring member 9 and the operating member 10 respectively.

Figure 8:
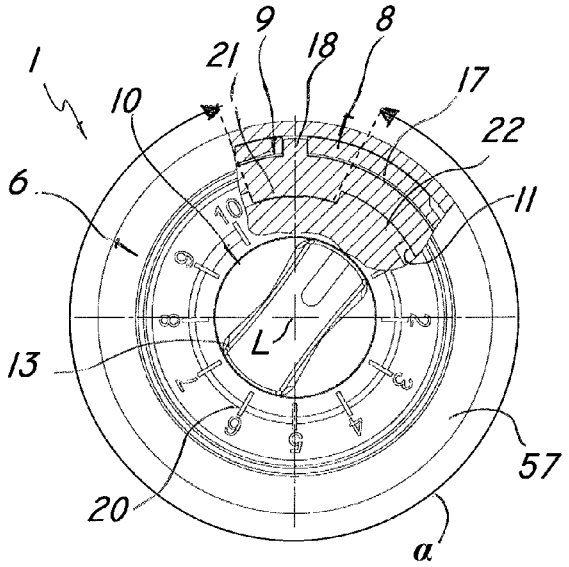
FIG. 8 is a partially broken-away top view of the assembly in a first operating position.
Figure 9:
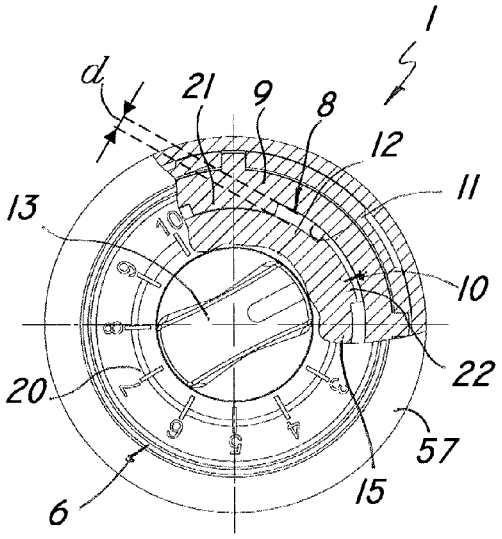
FIG. 9 is a partially broken-away top view of the assembly in a second operating position.

Conveniently, as best shown in FIGS. 8 and 9, the cylindrical surfaces have differentiated diameters, thereby leaving a sufficient radial clearance d for mutual rotation of the respective members 9, 10.

This arrangement of the parts will provide the advantage of blocking or considerably limiting the infiltration of impurities and liquids in the limit stop means 8.

Furthermore, the restriction of the maximum angle of rotation α of the shaft 4 obtained by the limit stop means 8 will afford controlled movement of the resistor and prevent shocks or impacts to its moving parts.

Figure 6:
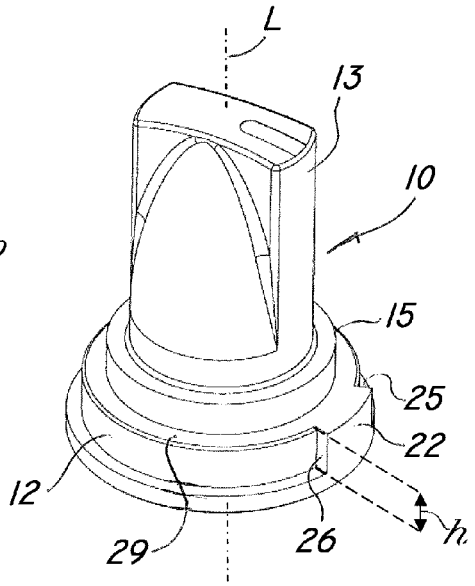
FIG. 6 is a perspective view of a second detail of the assembly.
Figure 7:
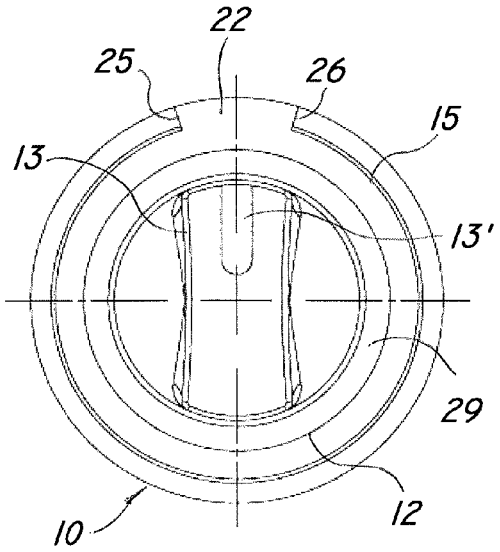
FIG. 7 is a top view of the detail of FIG. 6.

As shown in FIGS. 6 and 7, the operating member 10 comprises a hollow stem 13 that extends through a central opening 14 of the annular anchoring member 9.

The hollow stem 13 may be interiorly shaped to stably accommodate the adjustment shaft 4 therein and may have an enlarged lower portion 15 defining an annulus, whose outer lateral cylindrical surface 12 will define the cylindrical surface of the operating member 10.

The annulus 15 may be removably fitted into an annular seat 16 of the anchoring member, which is defined by the cylindrical surface 11.

The annular seat 16 may be substantially complementary to the annulus 15, for the latter to be fitted therein with a small clearance, to allow the stem 13 to be rotated about the longitudinal axis L with high accuracy.

Conveniently, for improved stability of the rotary connection of the adjustment shaft 4 and the stem 4, these parts may be equipped with complementary male and female attachment means. For example, as clearly shown in FIGS. 10 and 11, the stem 13 has a radial ridge 13' which is designed for engagement in a mating recess 7' formed in the upper end 7 of the shaft 4.

Conveniently, the anchoring member 9 removably fits in the housing 2, but is rotationally and axially locked relative to the housing when the assembly 1 is entirely assembled.

Figure 4:
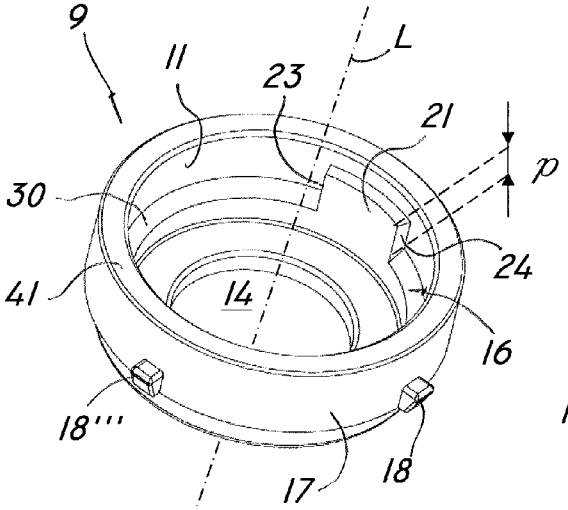
FIG. 4 is a perspective view of a first detail of the assembly.
Figure 5:
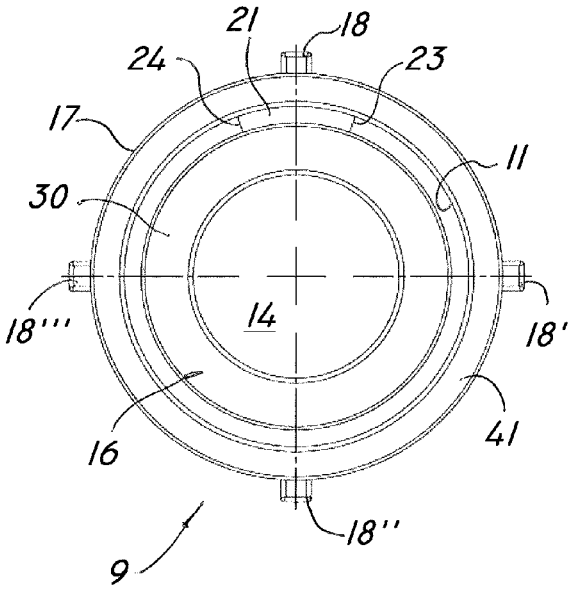
FIG. 5 is a top view of the detail of FIG. 4.

For this purpose, the anchoring member 9, which is shown in detail in FIGS. 4 and 5, has a substantially cylindrical outer surface 17 having a plurality of substantially radial projections 18, 18', 18", 18''' which are adapted to fit into corresponding and mating recesses 19, 19', 19", 19''' formed in the side wall of the housing 2, as shown in FIG. 3, to lock the rotation of the anchoring member 9 relative to the housing 2.

Preferably, the anchoring member 9 has a graduated scale 20, e.g. on the front annular surface of its outer surface 17, to provide an indication of the angular position assumed by the stem 13 and hence of the instantaneous value of electrical resistance.

The cylindrical surface 11 of the anchoring member 9 may have a depth p that is not smaller than the height h of the cylindrical surface 12 of the operating member 10, for the latter to entirely fit into the annular seat 16.

Furthermore, the limit stop means 8 may longitudinally extend throughout the depth p and height h of the facing cylindrical surfaces 11, 12.

Conveniently, the limit stop means 8 may comprise a pair of abutment members 21, 22 integral with respective facing surfaces 11, 12 of the anchoring member 8 and the operating member 10 and radially projecting therefrom for mutual interaction upon rotation of the shaft 4 by the maximum angle α.

Each abutment member 21, 22 comprises respective pairs of substantially flat front surfaces, referenced 23, 24 and 25, 26 respectively, which are designed for mutual abutment upon rotation of the shaft 4 by its maximum rotation angle α.

Conveniently, the knob 6 may have first seal means 27 interposed between the anchoring member 9 and the operating member 10 to ensure a minimum protection rating for the electrical adjustment device 3. The first seal means 27 may comprise a first annular seal 28, such as a simple O-ring or a lip seal, as shown in the figures, which is interposed between the annular seat 16 of the anchoring member 9 and the annulus 15 of the operating member 10. These seal means will block infiltration of dust and/or solid particles from the outside into the facing cylindrical surfaces 11, 12, thereby protecting the limit stop means 8 and preventing impurities or liquids in the outside environment from affecting their function.

Figure 10:
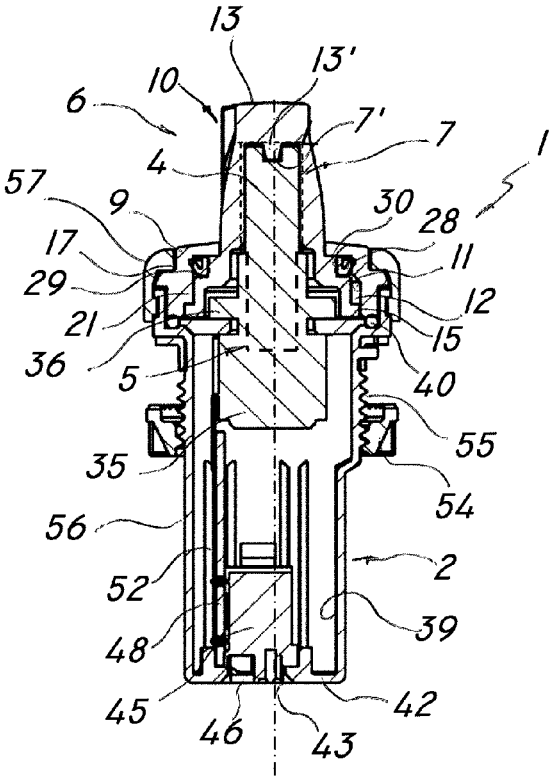
FIG. 10 is a sectional view of the assembly as taken along a first section plane.
Figure 11:
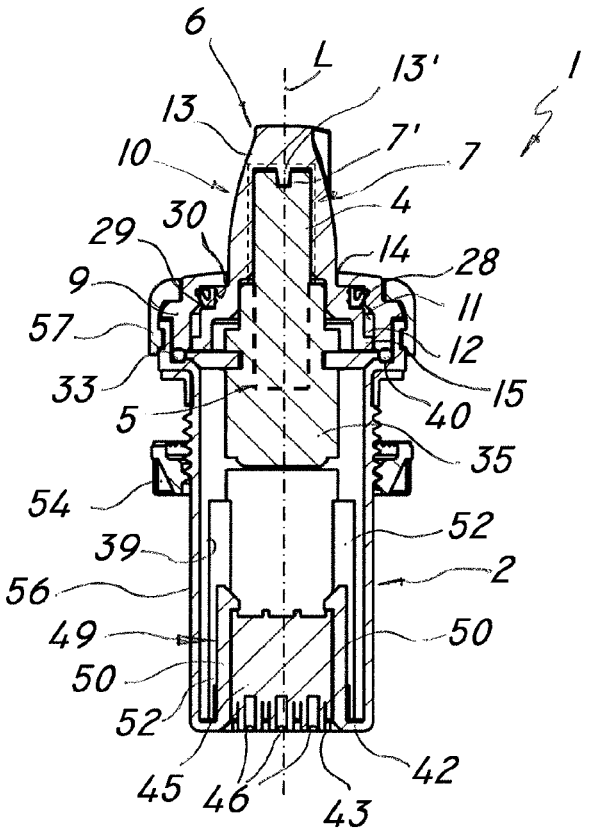
FIG. 11 is a sectional view of the assembly as taken along the section plane XI-XI of FIG. 2.
Figure 12:
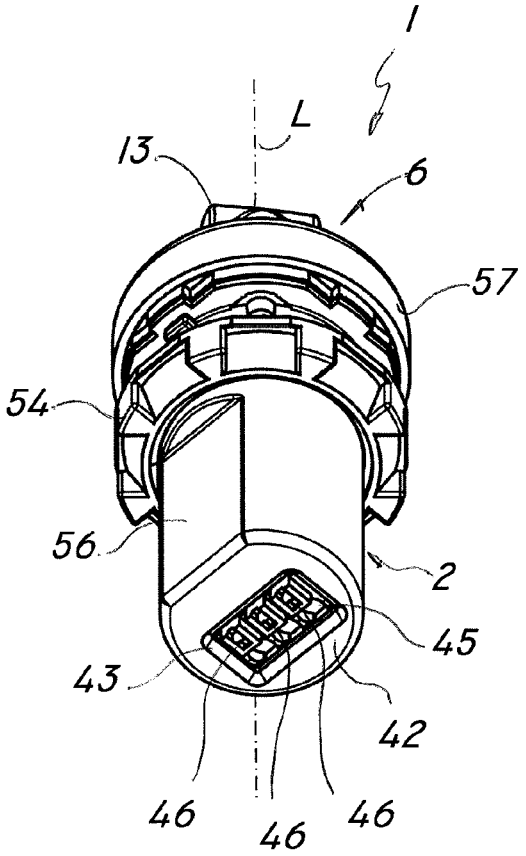
FIG. 12 is a bottom perspective view of the assembly.

As shown in FIGS. 10 and 11, the first seal 28 is accommodated on a first flat annular surface 29 of the annulus 15 of the operating member 10, which is designed to interact with a second flat annular surface 30 opposed to the seat 16 of the anchoring member 9.

It shall be further noted that the shaft 4 has a disk-shaped flange 31 which defines a seating surface 32 for the annulus of the operating member 10.

The substantially tubular housing 2 may in turn comprise a radially inwardly projecting third annular surface 33, which is adapted to define an abutment for the disk-shaped flange 31 and for axial positioning of the shaft 4.

In the illustrated embodiment, the shaft 4 is integral, at its lower end 5, with the block 35 that is adapted to house both the internal resistor and the electric circuit of the adjustment device 3.

Thus, the disk-shaped flange 31 may be fixed to the shaft 4 at the lower end 5 thereof and above the block 35, e.g. by means of a retaining nut 36, to rest upon the third annular surface 33.

Conveniently, the housing 2 may also accommodate second seal means 38 interposed between its inner surface 39 and the knob 6 and adapted to cooperate with the first seal means 27 to define a minimum protection rating IP67 according to EN60529.

Thus, the electrical adjustment device 3 may be thoroughly protected against penetration of solid bodies, dust, liquids, water splashes and jets and also temporary immersion.

Furthermore, the limit stop means 8 and the second end portion 7 of the shaft 4 attached to the knob 6 may be protected with a minimum protection rating IP67 according to EN60526.

For this purpose, the second seal means 38 may comprise a second annular seal 40 resting upon the third annular surface 33. As shown in FIGS. 10 and 11, the second seal 40 may interact with the flat bottom surface 41 of the anchoring member 9 of the knob 6.

The housing 2 may comprise a substantially flat bottom wall 42 with an opening formed therethrough for the passage of the wiring terminals of the assembly 1.

Furthermore, the housing 2 may contain a terminal block 45 for electrically connecting the electrical adjustment device 3 with the external circuit to be controlled, once wiring has been completed.

Particularly, the terminal block 45 is placed at the opening 43 and comprises one or more inputs 46 for connection to the external circuit to be controlled and one or more output pins, not shown and associated with respective inputs 46.

Also, the terminal block 45 is connected to an at least partially conductive plate which is adapted to electrically connect the output pins of the terminal block 45 with the terminals 47 of the electrical adjustment device 3.

Advantageously, as best shown in FIGS. 9 and 10, the housing 2 may have anchor means 49 in its lower portion, for snap engagement of the terminal block 45 at the bottom wall 42. Particularly, the snap-fit anchor means 49 comprise a pair of longitudinal hooks 50 integral with the bottom wall 42 and susceptible of transversely bending away from each other to allow the terminal block 45 to be press fitted and later snap-locked therebetween.

Conveniently, the substantially cylindrical inner side surface of the housing 2 has a pair of longitudinal slide guides 52 along which the conductive plate 48 is axially guided into its position.

Thus, irrespective of the particular configuration of the limit stop means 8, an assembly may be provided that allows quick, simple and stable positioning of the unit composed of the adjustment device 3 integral with the adjustment shaft 4, the conductive plate 48 and the terminal block 45, as it is being assembled.

These parts may be previously connected by adequate electrical connections and then introduced as a single unit into the housing 2, thereby ensuring that the whole unit is secured by the snap-fit anchor means 49 and the guides 52.

In a further particularly advantageous aspect of the invention, the assembly 1 may have screw means 53 for removable fixation thereof in a special passage of a control panel or board or the like, not shown.

Particularly, the screw means 53 may comprise an internally threaded nut 54 which is adapted to be tightened on a matingly threaded portion 55 of the outer surface 56 of the housing 2.

The housing 2 may have a lock ring 57 on the anchoring member 9 of the knob 6, which has the purpose of locking the latter relative to the housing 2, and also has a finishing function.

This particular configuration will provide an assembly 1 that, in its assembled state, has the form of a unit part, affording easy and quick installation. Indeed, since the electrical adjustment device 3 is already connected to the adjustment shaft 4, its installation will only require it to fit into the passage formed in the panel and be fastened by the screw means 53, and finally wired.

The above disclosure clearly shows that the invention fulfills the intended objects and particularly meets the requirement of providing a protection assembly according to the invention, which may be used for potentiometers having a high protection rating, and hence high reliability for both mechanical and electrical parts, and particularly ensuring protection against infiltration of dirt particles or liquids.

The protection assembly of this invention is susceptible to a number of changes and variants, within the inventive principle disclosed in the appended claims. All the details thereof may be replaced by other technically equivalent parts, and the materials may vary depending on different needs, without departure from the scope of the invention.

While the protection assembly has been described with particular reference to the accompanying figures, the numerals are only used for the sake of a better intelligibility of the invention and shall not be intended to limit the claimed scope in any manner.

The invention claimed is:

1. A protection assembly with an operating knob for an electrical potentiometer, comprising:

a substantially tubular housing (2) defining a longitudinal axis (L);

said housing (2) being designed to contain therein an electrical adjustment device (3) having an adjustment shaft (4) rotating about said longitudinal axis (L) and an internal variable resistor interacting with a longitudinal end (5) of said shaft (4);

an operating knob (6) attached to the other end (7) of said shaft (4);

limit stop means (8) for restricting the rotation of said shaft (4) within a predetermined maximum rotation angle ($\alpha$);

characterized in that said knob (6) comprises an annular anchoring member (9), which is designed to be removably coupled to said housing (2) and an operating member (10) coupled to said shaft (4) and rotating relative to said anchoring member (9), said anchoring member (9) and said operating member (10) having mutually facing cylindrical surfaces (11, 12), with said limit stop means (8) interposed therebetween to limit the infiltration of external impurities.

2. Assembly as claimed in claim 1, characterized in that said facing cylindrical surfaces (11, 12) are coaxial and have different diameters, thereby leaving a radial play (d), of predetermined amplitude sufficient to allow the mutual rotation of said anchor and operating members (9, 10) of said knob (6).

3. Assembly as claimed in claim 2, characterized in that said limit stop means (8) comprise first (21) and second (22) abutment members, each radially projecting out of a respective facing surface (11, 12) to restrict the maximum rotation of said shaft (4).

4. Assembly as claimed in claim 1, characterized in that said knob (6) comprises first seal means (27) interposed between said anchoring member (9) and said operating member (10).

5. Assembly as claimed in claim 4, characterized in that said operating member (10) comprises a hollow stem (13) which removably inserted into a central passage (14) of said annular anchoring member (9) and is adapted to accommodate said shaft (4), and further comprises an annular member (15) defining one of said cylindrical surfaces (12) and removably fitting in an annular seat (16) formed in said anchoring member (9) and defining the other of said cylindrical surfaces (11).

6. Assembly as claimed in claim 5, characterized in that said first seal means (27) comprise a first annular seal (28) interposed between said annular seat (16) of said anchoring member (9) and said annular member (15) of said operating member (10).

7. Assembly as claimed in claim 1, characterized in that said anchoring member (9) has a substantially cylindrical outer surface (17) having a plurality of substantially radial projections (18, 18', 18", 18''') which are adapted to fit into substantially mating recesses (19, 19', 19", 19''') of said housing (2), to lock said anchoring member (9) against rotation relative to said housing (2).

8. Assembly as claimed in claim 5, characterized in that said shaft (4) has one end interacting with said variable resistor and a disk-shaped flange (31) defining a seating surface (32) for said annulus (15) of said operating member (10), said substantially tubular housing (2) having a radially inwardly projecting annular surface (33) which defines an abutment for said disk-shaped flange (31) for axial positioning of said shaft (4).

9. Assembly as claimed in claim 1, characterized in that said housing (2) has snap fit means (49) at its bottom wall (42) for snap engagement (49) of said device (3).

* * * * *